US012246763B2

(12) United States Patent
Wang et al.

(10) Patent No.: US 12,246,763 B2
(45) Date of Patent: Mar. 11, 2025

(54) DEGRADATION MANAGEMENT METHOD FOR VERSATILE SIGNAL SYSTEM, DEVICE AND MEDIUM

(71) Applicant: CASCO SIGNAL LTD., Shanghai (CN)

(72) Inventors: Zhaoyao Wang, Shanghai (CN); Xiaoyong Wang, Shanghai (CN); Huaxiang Liu, Shanghai (CN); Donghai Wang, Shanghai (CN); Xiaoque Ling, Shanghai (CN); Liang Pan, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 0 days.

(21) Appl. No.: 18/016,678

(22) PCT Filed: Nov. 4, 2021

(86) PCT No.: PCT/CN2021/128585
§ 371 (c)(1),
(2) Date: Jan. 18, 2023

(87) PCT Pub. No.: WO2023/040016
PCT Pub. Date: Mar. 23, 2023

(65) Prior Publication Data

US 2024/0239390 A1 Jul. 18, 2024

(30) Foreign Application Priority Data

Sep. 16, 2021 (CN) ..... 202111085374.4

(51) Int. Cl.
*B61L 27/30* (2022.01)
*B61L 27/20* (2022.01)

(52) U.S. Cl.
CPC ..... *B61L 27/30* (2022.01); *B61L 27/20* (2022.01)

(58) Field of Classification Search
CPC ..... B61L 27/30; B61L 27/20; B61L 27/00; B61L 2027/202
(Continued)

(56) References Cited

FOREIGN PATENT DOCUMENTS

CN 110920694 * 3/2020 ..... B61L 27/00
CN 111688767 * 9/2020 ..... B61L 27/00
(Continued)

OTHER PUBLICATIONS

"International Search Report (Form PCT/ISA/210) of PCT/CN2021/128585," mailed on Jun. 16, 2022, pp. 1-4.
(Continued)

*Primary Examiner* — Hai H Huynh
(74) *Attorney, Agent, or Firm* — JCIPRNET

(57) ABSTRACT

A disclosure relates to a degradation management method for a versatile signal system, a device and a medium. The versatile signal system supports both the CTCS system for the national railway and the CBTC system for the urban railway; the method controls the safety of trains equipped with the CTCS system or the CBTC system on the same line, and effectively conducts degraded operation management; and the management method comprises switching between normal operation modes of the CTCS system and the CBTC system, switching between degraded operation modes, and switching between normal operation modes and degraded operation modes in a shared area. Compared with the prior art, the disclosure has the advantage that effective degradation operation mode management on trains running on a line under a CTCS+CBTC signal system is realized.

10 Claims, 5 Drawing Sheets

(58) Field of Classification Search
USPC ..... 701/19, 20
See application file for complete search history.

(56) References Cited

FOREIGN PATENT DOCUMENTS

| | | | | |
|---|---|---|---|---|
| CN | 112678034 | * | 4/2021 | ..... B61L 27/00 |
| CN | 113147835 | * | 7/2021 | ..... B61L 27/00 |
| CN | 113799853 | * | 12/2021 | ..... B61L 27/00 |

OTHER PUBLICATIONS

"Written Opinion of the International Searching Authority (Form PCT/ISA/237) of PCT/CN2021/128585," mailed on Jun. 16, 2022, pp. 1-3.

* cited by examiner

DEGRADATION MANAGEMENT METHOD FOR VERSATILE SIGNAL SYSTEM, DEVICE AND MEDIUM

CROSS-REFERENCE TO RELATED APPLICATION

This application is a 371 of international application of PCT application serial no. PCT/CN2021/128585, filed on Nov. 4, 2021, which claims the priority benefit of China application no. 202111085374.4, filed on Sep. 16, 2021. The entirety of each of the above mentioned patent applications is hereby incorporated by reference herein and made a part of this specification.

TECHNICAL FIELD

The invention relates to train signal control systems, in particular to a degradation management method for a versatile signal system, a device and a medium.

BACKGROUND TECHNIQUE

At present, two systems are widely used in the field of rail transit operation control in China, which are China Train Control System (CTCS) applied to trunk railways and Communication Based Train Control (CBTC) system applied to urban rail transit. Specifically, the CTCS C2 train control system is mainly used in 160-250 km/h lines, which belongs to the national railway system. The CBTC system can support up to 200 km/h lines through two-way information transmission of an LTE wireless network, which belongs to the urban rail transit system.

In order to meet the need for smart travel in urban agglomerations, city/intercity line (railway/express rail) development plans have been released one after another by the national, local and industrial bodies in recent years. The interconnection of intercity railways, urban railways and urban rail transit is an important development trend. However, neither of the two single signal network systems can meet the essential requirements of urban lines for both public transportation and interoperability. Therefore, it is necessary to make use of the respective advantages of CTCS and CBTC in interoperability and public transportation, and adopt a CTCS+CBTC multi-network integration system to meet the essential requirements of urban lines. A train control system integrating CBTC and CTCS is one of the research focuses in the field of rail transit now.

Degradation management is an important measure to ensure the safety of train operation. During the actual operation of trains, degradation management and control are often carried out according to the line state, weather, construction and maintenance situations, etc. Therefore, how to manage the degraded running mode safely and effectively is important to ensure safe operation of trains with various systems.

At present, the CTCS+CBTC multi-network integration system requires stopping at a designated position in an area covered by both the CTCS system and the CBTC system (shared area) for manual switch of operation modes, which greatly affects the operation efficiency of the system. Moreover, the current urban rail transit has the demand for unmanned operation, so how to smoothly switch between the unmanned mode and the degraded mode is also a problem that needs to be considered.

SUMMARY OF THE INVENTION

In order to overcome the defects in the prior art, the invention provides a degradation management method for a versatile signal system, a device and a medium.

The purpose of the invention can be realized by the following technical scheme.

According to a first aspect of the invention, a degradation management method for a versatile signal system is provided, wherein the versatile signal system supports both the CTCS system for the national railway and the CBTC system for the urban railway. The method controls the safety of trains equipped with the CTCS system or the CBTC system on the same line, and effectively conducts degraded operation management. The management method comprises switching between normal operation modes of the CTCS system and the CBTC system, switching between degraded operation modes, and switching between normal operation modes and degraded operation modes in a shared area.

As a preferred technical scheme, the method supports a collinear operation scenario and a cross-line operation scenario, the collinear operation scenario means that the CTCS line and the CBTC line share the same track, and the cross-line operation scenario means that a train can seamlessly run on the CTCS line or the CBTC line.

As a preferred technical scheme, in the collinear operation scenario, CTCS and CBTC trains are each equipped with a single-system vehicle-mounted device, only a CTCS system trackside device is arranged in a CTCS system area, only a CBTC system trackside device is arranged in a CBTC system area, and CTCS and CBTC trackside devices are arranged in a collinear area of the CTCS system and the CBTC system.

As a preferred technical scheme, in the cross-line operation scenario, CTCS and CBTC trains are each equipped with a dual-system vehicle-mounted device, only a CTCS system trackside device is arranged in a CTCS system area, only a CBTC system trackside device is arranged in a CBTC system area, and CTCS and CBTC trackside devices are arranged in a cross-line transition area.

As a preferred technical scheme, the operation management modes of CTCS and CBTC are compatible in the versatile signal system, and the train can keep a single operation management mode of CTCS or CBTC, or switch between the operation management modes of CTCS and CBTC, thus realizing the compatibility of operation management modes under the versatile signal system.

As a preferred technical scheme, operation mode switching of the versatile signal system supports switching between the normal operation mode and degraded operation mode under the CTCS system and the normal operation mode and degraded operation mode under the CBTC system.

As a preferred technical scheme, the method supports operation mode switching between different systems in the shared area, stopping or not stopping, so as to ensure the normal operation of trains in the shared area and smooth switching of the operation modes.

As a preferred technical scheme, the implementation of the method is based on the same vehicle-mounted safety platform.

As a preferred technical scheme, the method allows degraded operation mode switching only in the shared area.

As a preferred technical scheme, the degraded operation mode switching specifically comprises:

in the shared area, according to the status of a line device, completing initial registration of the operating mode under a system to be switched first, and then exiting the operating mode of the current system while switching to the operating mode of a next system, thus realizing the cancellation of the operating mode of the current system.

As a preferred technical scheme, for degraded operation mode switching in the collinear area, matching with the conditions of the operation mode under a system to be switched according to the status of a trackside device, a vehicle-mounted device and a network device on the current line is required, and only when the conditions of the operating mode under the system to be switched are met, can the switching be made.

According to a second aspect of the invention, an electronic device is provided, which comprises a memory and a processor, a computer program is stored on the memory, and the processor implements the method when executing the program.

According to a third aspect of the invention, a computer-readable storage medium on which a computer program is stored is provided, and the program, when executed by a processor, implements the method.

Compared with the prior art, the invention has the following advantages.

(1) The invention can realize effective degradation operation mode management on trains running on a line under a CTCS+CBTC signal system.

(2) In the invention, CTCS and CBTC signal systems are compatible, which is conductive to both line upgrading and line expansion, thus improving the use efficiency of trains.

(3) The invention supports switching between various operation modes under different systems under the condition of stopping or not stopping, so as to ensure the normal operation of trains in the shared area. Mode switching without stopping improves the operation efficiency of the system.

(4) The invention not only supports switching between the normal operation modes of CTCS and CBTC and between the degraded operation modes of CTCS and CBTC, but also supports switching between the normal operation mode and the degraded operation mode, so as to effectively improve the operation efficiency of trains in the shared area.

(5) The invention can adapt to the collinear and cross-line operation scenarios of CTCS and CBTC.

(6) Based on the same vehicle-mounted device platform, the invention realizes degraded mode management under different systems, which can reduce the hardware cost and installation space of a vehicle-mounted system device.

DETAILED DESCRIPTION OF THE EMBODIMENTS

Figure 1:
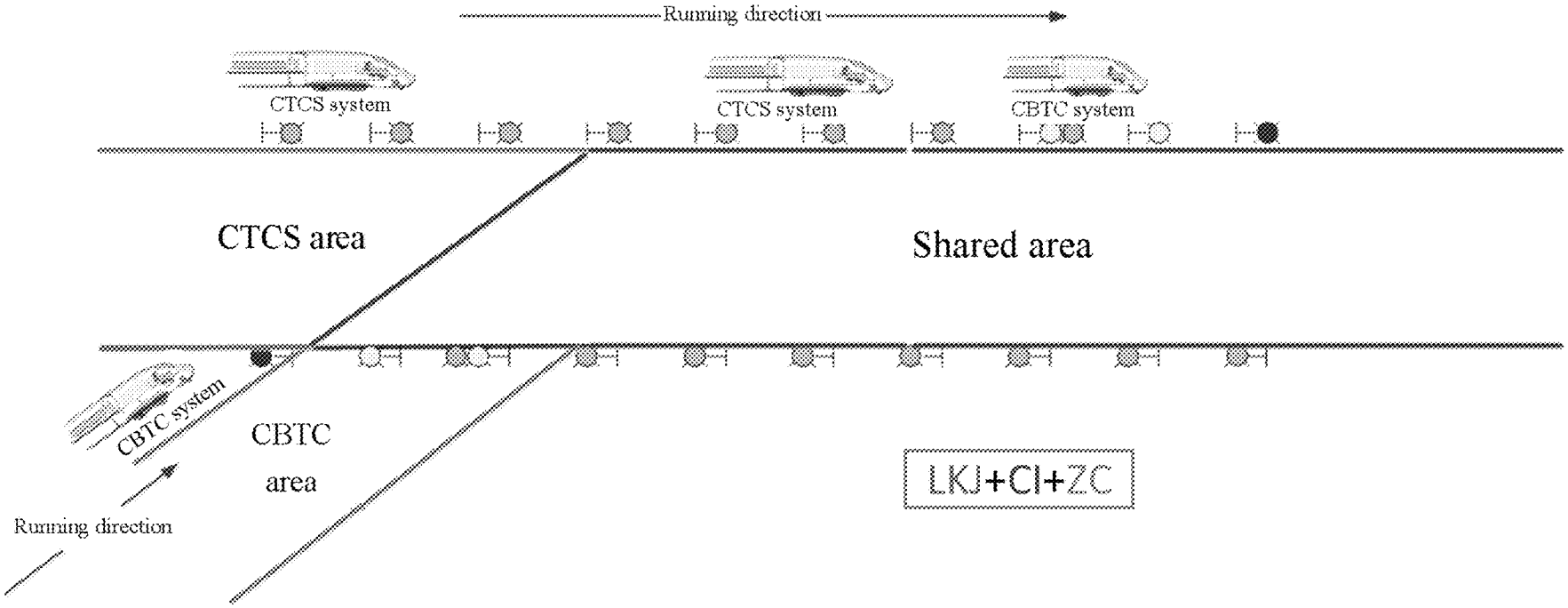
FIG. 1 shows a device layout under a collinear operation scenario.

Hereinafter, the technical scheme in the embodiments of the invention will be described clearly and completely with reference to the drawings in the embodiments of the invention. Obviously, the described embodiments are only part of the embodiments of the invention, not all of the embodiments. Based on the embodiments of the invention, all other embodiments obtained by those of ordinary skill in the art without creative labor are within the scope of the invention.

In order to meet the needs of city railways, intercity railways and urban rail transit for interconnection and intercommunication, the invention conducts safety control on trains equipped with the CTCS system for national railways or the CBTC system for urban railways when running on the same line, degraded operation management is realized effectively, and safe operation of trains equipped with train control systems of various modes on the line is ensured.

The invention provides a degradation management method for a versatile signal system.

According to the situation of line planning, the method involves a scenario where multiple systems are mixed, including collinear operation and cross-line operation. The collinear operation scenario means that the CTCS line and the CBTC line share the same track, and the cross-line operation scenario means that a train can seamlessly run on the CTCS line or the CBTC line.

In the collinear operation scenario, CTCS and CBTC trains are each equipped with a single-system vehicle-mounted device, only a CTCS system trackside device is arranged in a CTCS system area, only a CBTC system trackside device is arranged in a CBTC system area, and CTCS and CBTC trackside devices are arranged in a collinear area of the CTCS system and the CBTC system. The collinear area is provided with a single interlocking device and a single train control device.

In the cross-line operation scenario, CTCS and CBTC trains are each equipped with a dual-system vehicle-mounted device, only a CTCS system trackside device is arranged in a CTCS system area, only a CBTC system trackside device is arranged in a CBTC system area, and CTCS and CBTC trackside devices are arranged in a cross-line transition area. The cross-line transition area is provided with a single interlocking device and a single train control device.

The operation management modes of CTCS and CBTC are compatible in the versatile signal system, and the train can keep a single operation management mode of CTCS or CBTC, or switch between the operation management modes of CTCS and CBTC, thus realizing the compatibility of operation management modes under the versatile signal system.

Operation mode switching of the versatile signal system supports switching between the normal operation mode and degraded operation mode under the CTCS system and the normal operation mode and degraded operation mode under the CBTC system.

The management scheme not only supports switching between the normal operation modes of CTCS and CBTC and between the degraded operation modes of CTCS and CBTC in the shared area, but also supports switching between the normal operation mode and the degraded operation mode. When a train enters the shared area, after the corresponding conversion conditions are met, a driver can conduct operation mode switching under different systems according to the prompts on a vehicle-mounted human-machine interface (HMI).

The management scheme supports operation mode switching between different systems in the shared area, stopping or not stopping, so as to ensure the normal operation of trains in the shared area and smooth switching of the operation modes.

The implementation of the management scheme is based on the same vehicle-mounted safety platform, which can reduce the hardware cost and installation space of a vehicle-mounted system device.

The management scheme allows degraded operation mode switching only in the shared area. In the shared area, according to the status of a line device, initial registration of the operating mode under a system to be switched is completed first, and then the operating mode of the current system is exited while switching to the operating mode of a next system, thus realizing the cancellation of the operating mode of the current system. In this way, it is ensured that operation is conducted under one system only in the shared area, and both the switching security of the system and the usability of the system are guaranteed.

For this management scheme, for degraded operation mode switching in the collinear area, matching with the conditions of the operation mode under a system to be switched according to the status of a trackside device, a vehicle-mounted device and a network device on the current line is required, and only when the conditions of the operating mode under the system to be switched are met, can the switching be made.

Specific Embodiments

Figure 2:
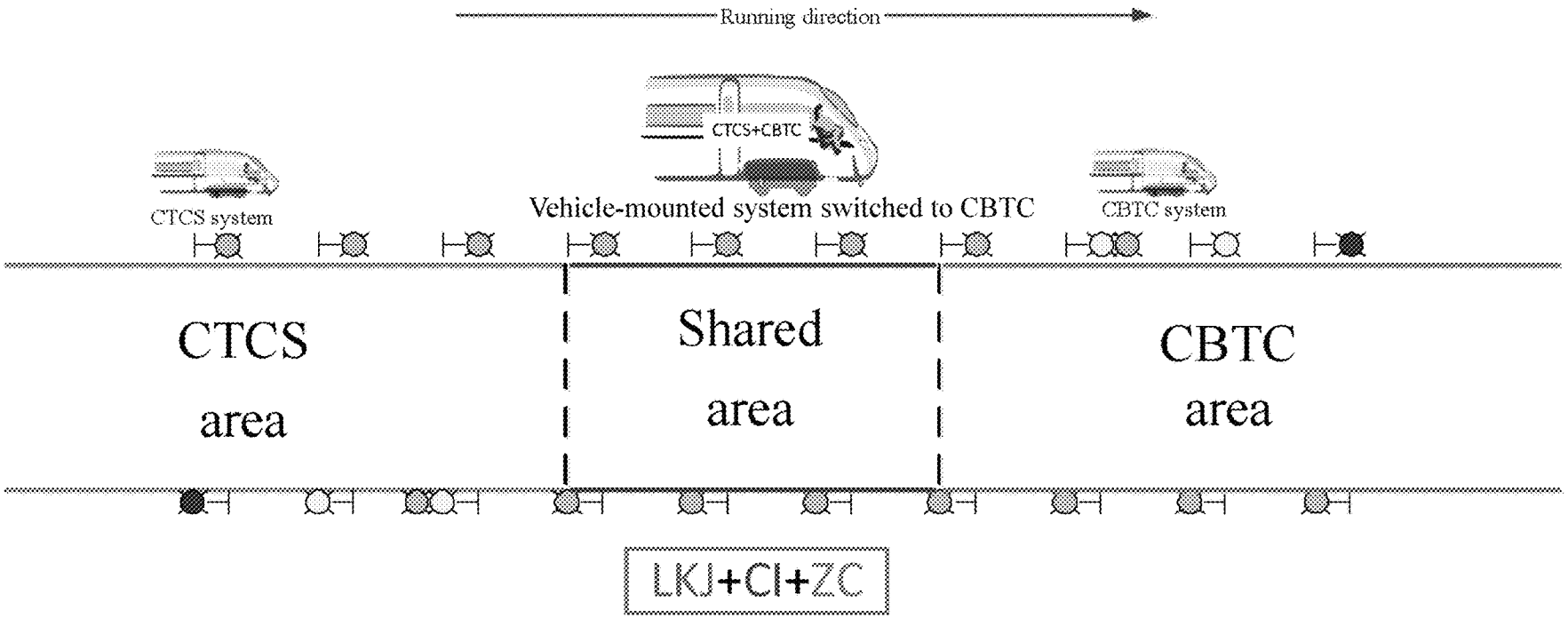
FIG. 2 shows a device layout under a cross-line operation scenario.

Device layouts of a versatile signal system are shown in FIGS. 1 and 2. FIG. 1 shows a device layout under a collinear operation scenario, where according to the line conditions, a train can be equipped with a single CTCS or CBTC vehicle-mounted device, while CTCS and CBTC trackside devices are arranged in a shared area. FIG. 2 shows a device layout under a cross-line operation scenario, where a train is equipped with a single vehicle-mounted device including both a CTCS system and a CBTC system, while CTCS and CBTC trackside devices are arranged in a shared area.

Figure 3:
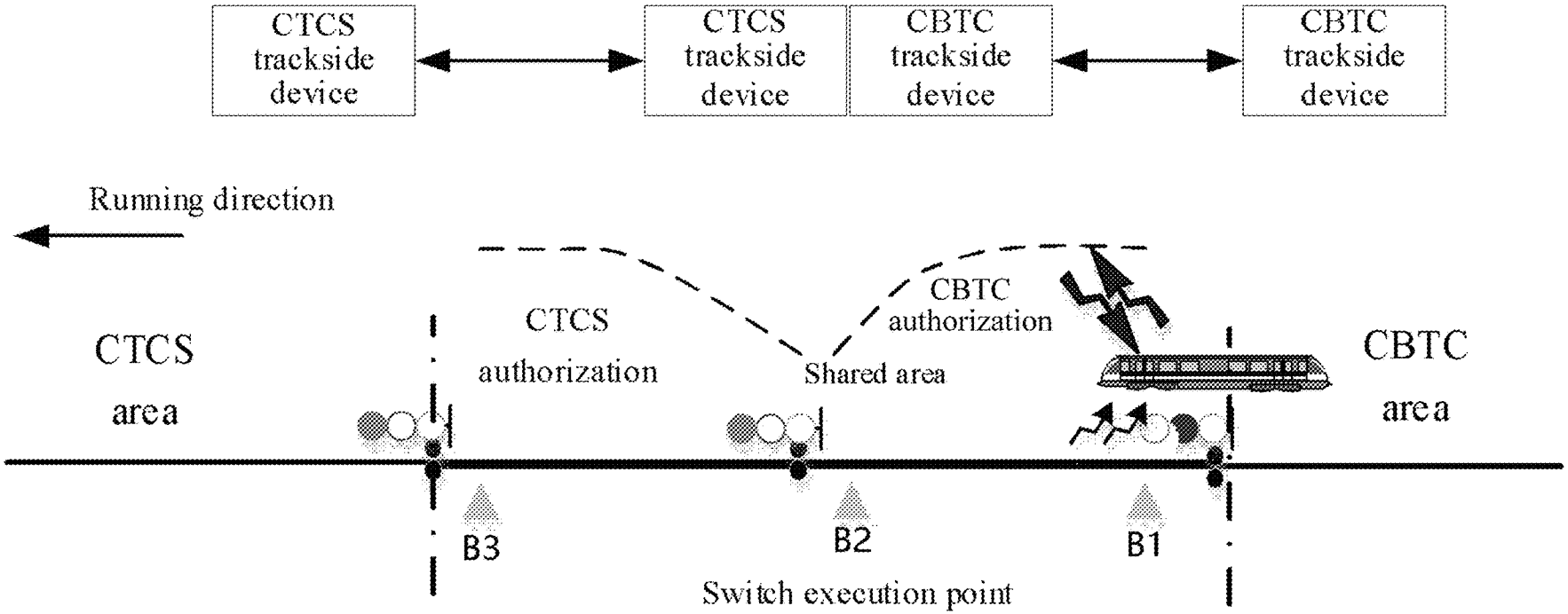
FIG. 3 is a schematic diagram of degraded operation mode switching.

Degradation management mode switching of the versatile signal system needs to be completed in the shared area. As shown in FIGS. 1 and 2, the CTCS and CBTC trackside devices are arranged in the shared area, and a transponder indicating switching (as shown in FIG. 3) is also arranged in the shared area.

In the collinear operation scenario, as shown in FIG. 1, the CTCS and CBTC trackside devices are arranged in the shared area. A train enters the shared area from a CTCS area or a CBTC area, and because the shared area is equipped with the trackside device of the corresponding system, the train can keep the degraded mode of the previous system and continue to run in the shared area.

In the cross-line operation scenario, as shown in FIG. 2, only the corresponding trackside device is arranged in the respective system area, and the CTCS and CBTC trackside devices are arranged in the shared area. After a train enters the shared area from the CTCS area or the CBTC area, the train needs to determine the degraded mode of the corresponding system in the next area according to the statuses of the trackside device, vehicle-mounted device and network, and complete degraded mode switching between the systems in the shared area.

Figure 4:
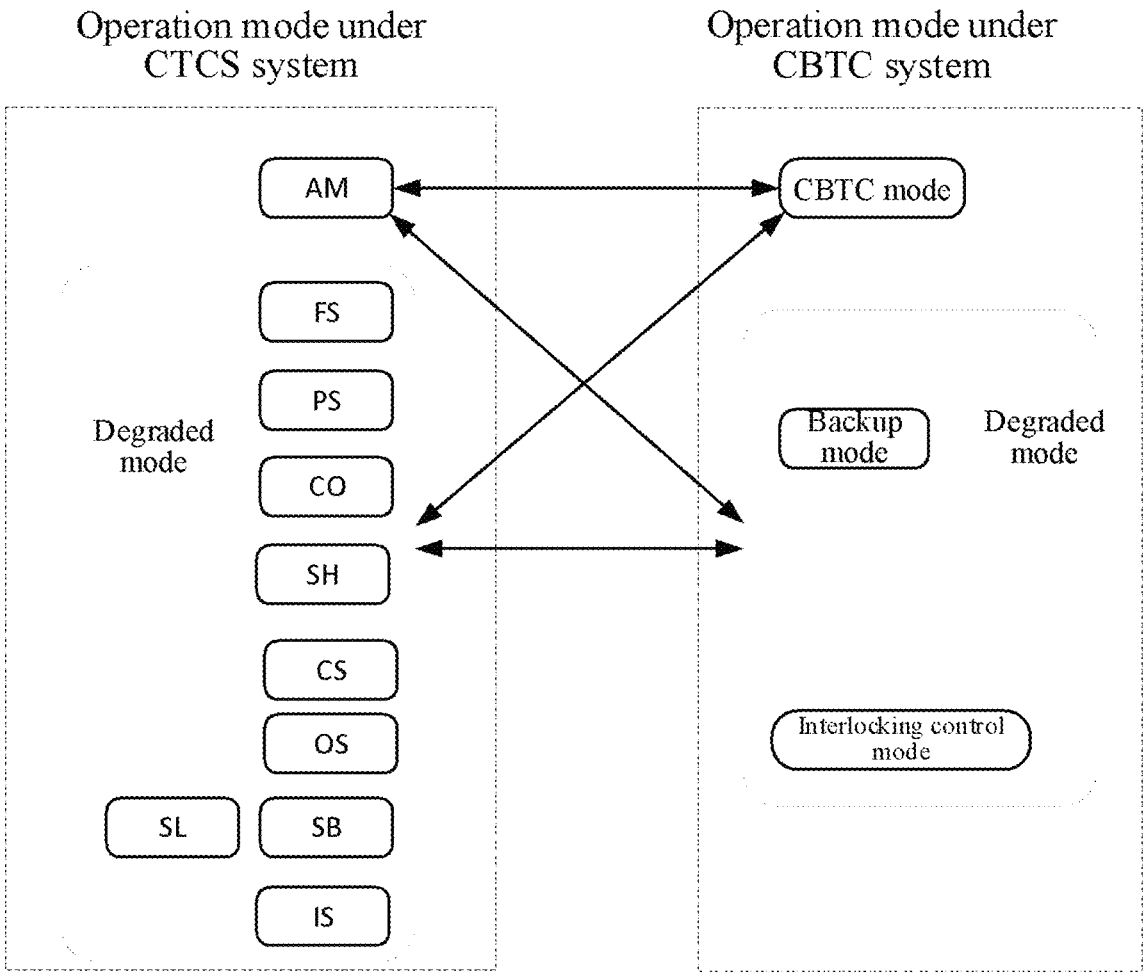
FIG. 4 is a state diagram of degraded operation mode switching.

As shown in FIG. 4, the normal operation mode of CTCS can be switched to the normal operation mode or degraded operation mode of CBTC, and the degraded operation mode of CTCS can also be switched to the normal operation mode or degraded operation mode of CBTC, or vice versa.

Figure 5:
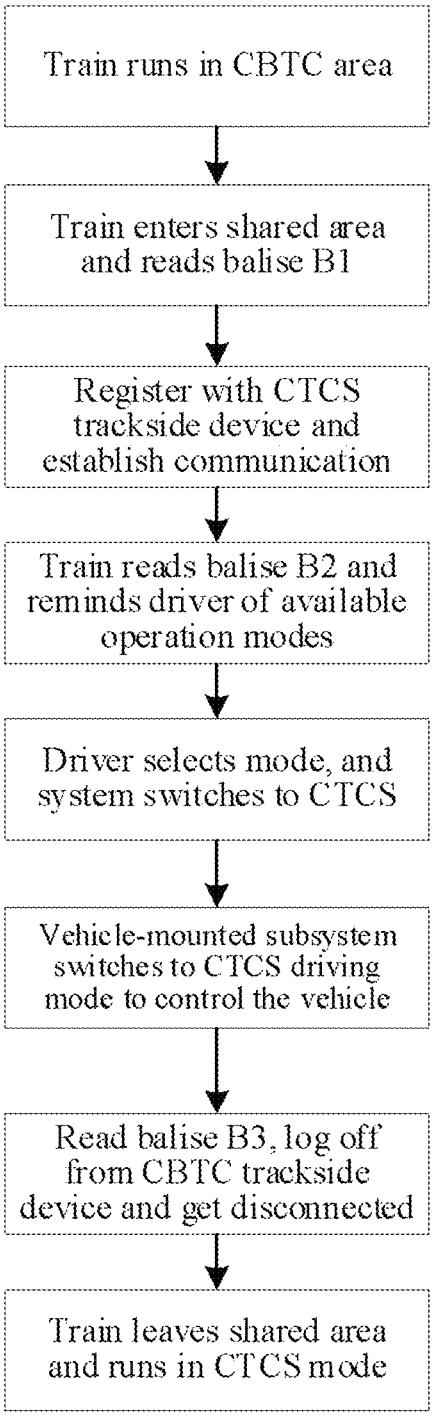
FIG. 5 is a flowchart of degraded operation mode switching.

The degraded mode switching process of the versatile signal system will be explained by assuming that a train runs from the CBTC area to the CTCS area (as shown in FIG. 5).

Step 1: The train runs in the CBTC area in a CBTC degraded mode.

Step 2: After entering the shared area and reads a transponder B1, the train reads the information of the balise.

Step 3: The train registers with the CTCS trackside device, establishes communication, and receives trackside variables and mobile authorization information, and a vehicle-mounted system calculates the available degraded operation modes in front according to the received trackside information and network state in combination with its own state.

Step 4: The train reads a balise B2, and the vehicle-mounted system displays the available degraded operation modes in front on a vehicle-mounted HMI for a driver to choose.

Step 5: Under the condition that the train stops or does not stop, the driver confirms the selection result according to the prompt of the vehicle-mounted HMI, and conducts CTCS/CBTC degraded operation.

Step 6: The vehicle-mounted system switches the degraded operation mode to the corresponding degraded operation mode under CTCS according to the selection result of the driver, and exits the degraded operation mode under CBTC.

Step 7: After the train reads a balise B3, the vehicle-mounted system logs off from the CBTC trackside device and is disconnected from the CBTC trackside device.

Step 8: The train leaves the shared area, and runs in the CTCS degraded operation mode.

An electronic device of the invention comprises a central processing unit (CPU) which can execute various appropriate actions and operations according to computer program instructions stored in a read-only memory (ROM) or computer program instructions loaded into a random access memory (RAM) from a storage unit. In the RAM, various programs and data required for the operation of the device can also be stored. The CPU, ROM and RAM are connected to each other through a bus. An input/output (I/O) interface is also connected to the bus.

Many components in the device are connected to the I/O interface, including: input units such as keyboards and mouses, output units such as various types of displays and speakers, storage units such as magnetic disks and optical disks, and communication units such as network cards, modems and wireless communication transceivers. The communication unit allows the device to exchange information/data with other devices through computer networks such as the Internet and/or various telecommunication networks.

The processing unit executes the various methods and operations described above, such as the method of the invention. For example, in some embodiments, the method of the invention can be implemented as computer software programs tangibly embodied in a machine-readable medium, such as the storage unit. In some embodiments, part or all of the computer program can be loaded and/or installed on the device via the ROM and/or communication unit. When the computer program is loaded into the RAM and executed by the CPU, one or more steps of the method of the invention described above may be performed. Alternatively, in other embodiments, the CPU may be configured to execute the method of the invention by any other suitable means (for example, by means of firmware).

The functions described above can be at least partially performed by one or more hardware logic components. For example, without limitation, exemplary hardware logic components that can be used include: Field Programmable Gate Array (FPGA), Application Specific Integrated Circuit (ASIC), Application Specific Standard Product (ASSP), System on Chip (SOC), Complex Programmable Logic Device (CPLD), etc.

The program code for implementing the method of the invention can be written in any combination of one or more programming languages. These program codes may be provided to the processors or controllers of general-purpose computers, special-purpose computers or other programmable data processing devices, so that when executed by the processors or controllers, the program codes cause the functions/operations specified in the flowcharts and/or block diagrams to be implemented. The program codes can be completely executed on a machine, partially executed on a machine, partially executed on a machine as an independent software package, partially executed on a remote machine or completely executed on a remote machine or server.

In the context of the invention, a machine-readable medium can be a tangible medium that can contain or store a program for use by or in connection with an instruction execution system, apparatus or device. The machine-readable medium may be a machine-readable signal medium or a machine-readable storage medium. Machine-readable media can include, but are not limited to, electronic, magnetic, optical, electromagnetic, infrared, or semiconductor systems, apparatuses or devices, or any suitable combination of the above. More specific examples of machine-readable storage media will include electrical connection based on one or more wires, portable computer disk, hard disk, random access memory (RAM), read-only memory (ROM), erasable programmable read-only memory (EPROM or flash memory), optical fiber, compact disk read-only memory (CD-ROM), optical storage device, magnetic storage device, or any suitable combination of the above.

The above are only specific embodiments of the invention, but the protection scope of the invention is not limited thereto. Any person familiar with the technical field can easily think of various equivalent modifications or substitutions within the technical scope disclosed by the invention, and these modifications or substitutions should fall within the protection scope of the invention. Therefore, the protection scope of the invention shall be subject to the protection scope of the claims.

What is claimed is:

1. A degradation management method for a versatile signal system, wherein the versatile signal system supports both a China Train Control System (CTCS) system for a national railway and a Communication Based Train Control (CBTC) system for a urban railway; the method controls a safety of trains equipped with the CTCS system or the CBTC system on the same line, and effectively conducts degraded operation management; and the degradation management method comprises switching between normal operation modes of the CTCS system and the CBTC system, switching between degraded operation modes, and switching between normal operation modes and degraded operation modes in a shared area;

wherein the degradation management method allows the degraded operation mode switching only in the shared area;

wherein the degraded operation mode switching specifically comprises:

in the shared area, according to a status of a line device, completing an initial registration of an operating mode under a system to be switched first, and then exiting the operating mode of a current system while switching to the operating mode of a next system, thus realizing cancellation of the operating mode of the current system;

wherein for degraded operation mode switching in a collinear area, matching with conditions of an operation mode under a system to be switched according to a status of a trackside device, a vehicle-mounted device and a network device on current line is required, and only when the conditions of an operating mode under the system to be switched are met, can the switching be made.

2. The degradation management method for the versatile signal system according to claim 1, wherein the degradation management method supports a collinear operation scenario and a cross-line operation scenario, the collinear operation scenario means that a CTCS line and a CBTC line share a same track, and the cross-line operation scenario means that a train can seamlessly run on the CTCS line or the CBTC line.

3. The degradation management method for the versatile signal system according to claim 2, wherein in the collinear operation scenario, CTCS trains and CBTC trains are each equipped with a single-system vehicle-mounted device, only a CTCS system trackside device is arranged in a CTCS system area, only a CBTC system trackside device is arranged in a CBTC system area, and a CTCS trackside devices and a CBTC trackside devices are arranged in a collinear area of the CTCS system and the CBTC system.

4. The degradation management method for the versatile signal system according to claim 2, wherein in the cross-line operation scenario, CTCS trains and CBTC trains are each equipped with a dual-system vehicle-mounted device, only a CTCS system trackside device is arranged in a CTCS system area, only a CBTC system trackside device is arranged in a CBTC system area, and a CTCS trackside devices and a CBTC trackside devices are arranged in a cross-line transition area.

5. The degradation management method for the versatile signal system according to claim 1, wherein operation management modes of a CTCS and a CBTC are compatible in the versatile signal system, and the trains can keep a single operation management mode of the CTCS or the CBTC, or switch between the operation management modes of the CTCS and the CBTC, thus realizing the compatibility of the operation management modes under the versatile signal system.

6. The degradation management method for the versatile signal system according to claim 1, wherein operation mode switching of the versatile signal system supports switching between the normal operation modes and degraded operation mode under the CTCS system and the normal operation modes and degraded operation mode under the CBTC system.

7. The degradation management method for the versatile signal system according to claim 1, wherein the degradation management method supports operation modes switching between different systems in the shared area, stopping or not stopping, so as to ensure normal operation of trains in the shared area and smooth switching of the operation modes.

8. The degradation management method for the versatile signal system according to claim 1, wherein implementation of the degradation management method is based on a same vehicle-mounted safety platform.

9. An electronic device, comprising a memory and a processor, wherein the memory stores a computer program, and the processor, when executing the program, implements the degradation management method of claim 1.

10. A computer-readable storage medium on which a computer program is stored, wherein the program, when executed by a processor, implements the degradation management method of claim 1.

* * * * *